US010024587B2

(12) United States Patent
Schaefer et al.

(10) Patent No.: US 10,024,587 B2
(45) Date of Patent: Jul. 17, 2018

(54) EVAPORATOR HEAT EXCHANGER UNIT

(71) Applicant: Magna Powertrain Bad Homburg GmbH, Bad Homburg (DE)

(72) Inventors: Tilo Schaefer, Daubach (DE); Gholam Reza Zakeri, Bad Vilbel (DE)

(73) Assignee: MAGNA POWERTRAIN BAD HOMBURG GMBH, Bad Homburg (DE)

( * ) Notice: Subject to any disclaimer, the term of this patent is extended or adjusted under 35 U.S.C. 154(b) by 738 days.

(21) Appl. No.: 14/192,685

(22) Filed: Feb. 27, 2014

(65) Prior Publication Data

US 2014/0174120 A1 Jun. 26, 2014

Related U.S. Application Data

(63) Continuation of application No. PCT/EP2012/003590, filed on Aug. 24, 2012.

(51) Int. Cl.
*F25B 39/02* (2006.01)
*F25B 40/00* (2006.01)
*F25B 41/06* (2006.01)

(52) U.S. Cl.
CPC ..... *F25B 39/02* (2013.01); *F25B 40/00* (2013.01); *F25B 41/062* (2013.01); *F25B 2339/024* (2013.01); *F25B 2339/0242* (2013.01); *F25B 2400/051* (2013.01); *F25B 2400/052* (2013.01); *F25B 2400/054* (2013.01); *F25B 2500/18* (2013.01)

(58) Field of Classification Search
CPC .... F25B 43/006; F25B 39/02; F25B 2500/18; F25B 7/00; F25B 2339/024; F25B 2339/0242; F25B 2400/051; F25B 2400/052; F25B 2400/054
See application file for complete search history.

(56) References Cited

U.S. PATENT DOCUMENTS 5,803,165 A * 9/1998 Shikazono ..... F28F 1/124 165/133
2003/0019614 A1* 1/2003 Iwamoto ..... F28F 1/32 165/133
2011/0296851 A1 12/2011 Duerr et al.

FOREIGN PATENT DOCUMENTS

DE 10 2008 060 699 6/2010
FR 2191089 A1 2/1974
(Continued)

OTHER PUBLICATIONS

Machine Translation of Description of JP2008265686; retreived on Jun. 2016.*

(Continued)

*Primary Examiner* — Orlando E Aviles Bosques
(74) *Attorney, Agent, or Firm* — Dickinson Wright PLLC

(57) ABSTRACT

An evaporator heat exchanger unit for a heating cooling module for a motor vehicle is disclosed. In one aspect, the evaporator heat exchanger unit includes at least one collector expansion tank for collecting a refrigerant and one evaporator, by which at least a part of the refrigerant can be converted into gaseous form. The evaporator heat exchanger unit also includes a housing enclosing an inner chamber, wherein in the inner chamber, the collector expansion tank, the evaporator, and a cooling medium are arranged, and wherein an expansion organ is arranged on the housing, by which the refrigerant is supplied to the evaporator.

17 Claims, 6 Drawing Sheets

(56) References Cited

FOREIGN PATENT DOCUMENTS

| | | | |
|---|---|---|---|
| JP | 09-89420 | A | 4/1997 |
| JP | 2002333241 | A | 11/2002 |
| JP | 2007192429 | A | 8/2007 |
| JP | 2008265686 | A | 11/2008 |
| WO | WO 2006/065185 | A1 | 6/2006 |

OTHER PUBLICATIONS

Machine Translation of Description of FR2191089; retreived on Jun. 2016.*

International Preliminary Report on Patentability for International Patent Application No. PCT/EP2012/003590 dated Mar. 13, 2014 by the International Bureau of WIPO.

International Search Report for International Patent Application No. PCT/EP2012/003590 dated Feb. 14, 2013 by the European Patent Office.

Notice of Rejection dated Apr. 18, 2016 in corresponding Japanese patent application Serial No. 2014-527524 (English Translation provided) (four pages).

* cited by examiner

III-III

IV-IV

EVAPORATOR HEAT EXCHANGER UNIT

CROSS-REFERENCE TO RELATED APPLICATIONS

This application is a continuation application, and claims the benefit under 35 U.S.C. §§ 120 and 365 of PCT Application No. PCT/EP2012/003590, filed on Aug. 24, 2012, which is hereby incorporated by reference. PCT/EP2012/003590 also claimed priority from German Patent Application No. DE 10 2011 111 964.0 filed on Aug. 31, 2011, which is hereby incorporated by reference.

BACKGROUND

Field

The described technology generally relates to an evaporator heat exchanger unit, and in particular to an evaporator heat exchanger unit for a heating cooling module for a motor vehicle.

Description of the Related Technology

For the standard heating cooling modules for an motor vehicle, a refrigerant passes through a refrigerant circuit, the refrigerant circuit usually includes at least a compressor, a gas cooler, an internal heat exchanger, an expansion element, an evaporator and an collector expansion tank. These components are generally connected in this order via pipes conducting the refrigerant, wherein in the condenser gas cooler heat is removed from the refrigerant and in the evaporator heat is supplied to the refrigerant. By these heat transfers, a temperature control of the interior chamber of a motor vehicle, a battery, a driving motor or an electronic system of the motor vehicle is carried out indirectly.

Based on typical heating and cooling modules for a motor vehicle such as in EP 1 990 221 A1 proposes a heating-cooling module, in which a condenser/gas cooler, an evaporator, and an internal heat exchanger are integrated in such way that a closed unit is formed. By this lower assembly costs should be realized and the length of the installed cooling medium tube should be reduced. In this case, these components having very different temperatures are integrated into a closed unit.

SUMMARY

One inventive aspect is an improved configuration of a heating cooling module for a motor vehicle, in which suitable components can be combined into one unit.

At least one of the disclosed embodiments provides the advantage that those parts of a heating cooling module for a motor vehicle, which have similar temperatures, are, in particular at least partially located within a housing surrounded by a housing. Thereby, it is particularly possible to minimize undesirable heat transfers in the refrigerant circuit and the heating cooling module can have smaller dimensions, thereby cost and space advantages arise.

Another aspect is an evaporator heat exchanger unit for a heating cooling module for a motor vehicle, especially for an electrically driven motor vehicle or a hybrid motor vehicle. However, the disclosed embodiments can also be applied for a heating cooling module of a motor vehicle with an internal combustion engine. At least one of the disclosed embodiments can also be applied for heating cooling modules for stationary applications, in particular buildings, or for heating cooling modules in other applications.

Another aspect is an evaporator heat exchanger unit for a heating-cooling module for a motor vehicle, comprising at least a collector expansion tank for collecting a refrigerant and an evaporator, which transforms at least a part of the refrigerant into a gaseous state. A housing which comprises at least two housing parts and which encloses an inner chamber houses at least the collector expansion tank, the evaporator and a cooling medium, whereby in this housing, an expansion element is arranged, by which the refrigerant is supplied to the evaporator.

Another aspect is an evaporator heat exchanger unit which is arranged in the refrigerant circuit of a heating cooling module for a motor vehicle. In the refrigerant flow, the evaporator heat exchanger unit is arranged between a gas cooler outlet and the compressor inlet. An evaporator heat exchanger unit can have at least a collector expansion tank, an evaporator, a housing and an expansion element. The housing comprising the at least two housing parts are designed such that it encloses an inner chamber in which the collector expansion tank and the evaporator are arranged and which contains the cooling medium. Between this cooling medium and the refrigerant in the evaporator a heat transfer is performed. Thereby, in particular the functionality of a heat exchanger is realized in the housing. In the expansion element being arranged on the housing, the cooling absorbs in this heat exchanger the heat of refrigerant supplied to the evaporator. After passing through the evaporator, the refrigerant is conducted into the collector expansion tank and is collected within the volume which is separated from the collector expansion tank.

Another aspect is a heating cooling module for a motor vehicle which can be a refrigerant circuit from which at various, at least two points heat or cold can be taken, in particular to control the temperature of the passenger compartment of a motor vehicle by the taking of the cold and/or the heat. The heating cooling module can have a gas cooler for extracting heat from the refrigerant circuit, an evaporator for absorbing heat in the refrigerant circuit, an internal heat exchanger, an expansion element, an collector expansion tank and a compressor and pipes, for example, pipelines for conducting the refrigerant between the several components of the heating cooling module. In addition, a heating cooling module can include a cooling medium circuit, by which the heat can be brought into the refrigerant in the evaporator of the heating cooling module.

The collector expansion tank can be a container, in which the refrigerant can be collected, which is fed to a volume within the collector expansion tank, wherein the collector expansion tank in particular encloses this volume. In the collector expansion tank, the refrigerant can be in a high proportion in gaseous form and in a low proportion in liquid form. The collector expansion tank is used in the heating cooling module in particular as a reservoir for the refrigerant and thus in particular for regulating the pressure conditions in the heating cooling module at different operating conditions.

The refrigerant can be a medium which can support heating and cooling transitions of this refrigerant, for example, a cooling medium of the evaporator heat exchanger unit and/or air from the surroundings of the vehicle and/or the inner chamber of the vehicle. In some embodiments, as the refrigerant are provided such cooling media which are suitable for use in heating-cooling modules for a motor vehicle, for example, carbon dioxide (CO2, R 744) or tetrafluoroethane (R 134a).

The evaporator can be an evaporator heat exchanger unit, by which at least a part the refrigerant supplied to the evaporator is converted from a liquid state to a gaseous state. A relaxing refrigerant is supplied to the evaporator via an expansion element, wherein the evaporator has a refrigerant conducting length, which is several time larger than each of the outer dimensions of the evaporator, whereby it has a large surface area, which is surrounded by a medium, in particular the cooling medium. In some embodiments, the evaporator and/or the refrigerant conducting elements, respectively are surrounded by the cooling medium having a higher temperature than the refrigerant, wherein heat is extracted from the cooling medium and at the same time as energy is transferred to the refrigerant at least a part of the refrigerant is converted into a gaseous state. The refrigerant is cooled in the process, and for example, it is used to cool the passenger compartment of the motor vehicle by taking heat from the air in the passenger compartment by the cooled cooling medium. Likewise, the cooled cooling medium can be used to cool electronic components or engine components or a driving unit comprising a motor and electronics, or a battery of the motor vehicle by removing the heat from each component which has to be cooled by using the cooled cooling medium.

The cooling medium can be a medium, which can deliver heat to a refrigerant at an evaporator, and which also can remove heat from the air, or from a passenger compartment of a motor vehicle, for example, by means of a the heat exchanger suitable for this purpose. In some embodiments, the cooling medium is held in the inner chamber enclosed by the housing of the evaporator heat exchanger unit and surrounds the evaporator. In some embodiments, the cooling medium is a water-containing medium, for example, a water-based medium, such as water, and/or a glycol containing medium, in particular glycol.

The housing can be a device which houses at least the collector expansion tank and the evaporator of the evaporator heat exchanger unit and a cooling medium. The housing encloses an inner chamber within which the collector expansion tank and the evaporator are disposed. This inner chamber is at least partially, or substantially completely filled with the cooling medium. On the housing, an expansion element is arranged. The expansion element can be arranged in a recess of this housing or in the inner chamber enclosed by the housing with or outside on the housing.

The expansion element can be a reduction of the cross-section in the refrigerant pipe in which the refrigerant has to pass through and at which the refrigerant flow can expand, wherein the refrigerant has a higher density and a higher pressure before the passage of the expansion element, while it has after passage of the expansion element a lower density and a lower pressure. After passage of the expansion element, the refrigerant is supplied to the evaporator in the evaporator heat exchanger unit.

In some embodiments, the evaporator is arranged to substantially surround the collector expansion tank. This allows a space saving combined arrangement of the evaporator and the collector expansion tank within the inner chamber enclosed by the at least two housing parts of the housing of the evaporator heat exchanger unit. The arrangement of the evaporator around the collector expansion tank is in particular such that a surface as big as possible of the evaporator is available for flowing around the cooling medium in the housing, for example, by that the length of the refrigerant conducting elements of the evaporator is by several times longer than each of the outer dimensions of the evaporator.

In some embodiments, the housing cover has at least one inlet recess through which the refrigerant can be guided into the evaporator arranged at the inner space enclosed by the housing, and at least one outlet recess through which the refrigerant can be discharged from the collector expansion tank arranged at the inner space enclosed by the housing.

This inlet recess and outlet recess can provide the refrigerant ports of the evaporator heat exchanger unit to those components of the heating cooling module for a motor vehicle, which are not elements of the evaporator heat exchanger unit. In some embodiments, the refrigerant passes before entering into the inlet recess or after discharging from the outlet recess a heat exchanger device. Moreover, the refrigerant passes through an expansion element which is located at the inlet recess. The refrigerant is guided from the inlet recess into the evaporator.

In some embodiments, through the outlet recess, the refrigerant which flows from the collector expansion tank and which passes a heat exchanger unit is discharged such that it passes to the compressor of the cooling heating module. It passes through further refrigerant conductors of the heating-cooling module, for example, the refrigerant pipes, arranged outside of the evaporator heat exchanger unit.

In some embodiments, the heat exchanger unit is arranged on and outside of the housing, wherein at least two spaced apart channels are arranged in this heat exchanger unit, and wherein in a first channel, a refrigerant flow to the expansion element and in a second channel, a refrigerant flow from the collector expansion tank are guided such that heat can be exchanged between the refrigerant flows. The heat exchanger unit can be integrally formed and for example, arranged on the housing such that the spaced apart channels are adapted to one another at the interface to the housing such, that the first channel is in registration with the inlet recess of the housing cover and that the second channel is in registration with the outlet recess of the housing cover. In this way, heat can be transferred between the refrigerant, which is guided into the evaporator heat exchanger unit, and the refrigerant, which is discharged from the evaporator heat exchanger unit.

In some embodiments, the housing includes at least one inlet opening, through which the cooling medium can be guided into the inner chamber defined by the housing, and at least one outlet opening, through which the cooling medium can be discharged from the inner chamber defined by the housing, wherein the cooling medium releases heat, in particular to the evaporator, and for example, to the collector expansion tank. Through the inlet opening in the housing, the relatively warmer cooling medium, in particular water or for example, a water-based medium is guided into the inner chamber of the housing for flowing around the evaporator. There, the cooling medium flows around the surface of the evaporator, which absorbs heat from the cooling medium due to the relatively cooler refrigerant guided into the evaporator. Then, it leaves cooled the inner chamber of the housing through the outlet opening of the housing.

In a further preferred embodiment of the evaporator heat exchanger unit, the collector expansion tank has at least one connection channel, through which the refrigerant can be guided into the collector expansion tank, and at least one discharge channel, through which the refrigerant can be discharged from the collector expansion tank. Through this connection channel, the refrigerant is supplied to the collector expansion tank from the evaporator, wherein the refrigerant is collected in the collector expansion tank. Through the outlet channel, the refrigerant is discharged from the collector expansion tank and, for example, after passage through the heat exchanger unit, it is supplied to the compressor of the cooling heating module.

In some embodiments, the expansion element is located in the refrigerant flow between the heat exchanger unit and the evaporator, wherein the expansion element is formed in an expansion element recess of one of the housing parts. In particular, the formation of an expansion element recess is provided within the inlet recess of the housing of the evaporator heat exchanger unit.

The expansion element recess can be a recess which is adapted to receive an expansion element such that the expansion element can cause expansion of the refrigerant in the refrigerant flow between a heat exchanger unit and an evaporator.

In some embodiments, the expansion element is located in the refrigerant flow between the heat exchanger device and the evaporator, wherein the expansion element is connected with one of the housing parts, in particular tightly and at least, indirectly connected. The expansion element can be arranged such that the refrigerant flow can be supplied through the expansion element directly to the inlet recess of the housing, or that the refrigerant flow can be supplied through the inlet recess of the housing directly to the expansion element.

In some embodiments, the collector expansion tank comprises a collector expansion tank pot and a collector expansion tank cap. The collector expansion tank pot is especially provided for collecting the refrigerant. The collector expansion tank cap encloses together with the collector expansion tank pot an inner volume of the collector expansion tank. The connecting channel and/or the discharge channel can be arranged on the collector expansion tank cap or on the collector expansion tank pot.

In some embodiments, the collector expansion tank cap and one of the housing parts are substantially integrally formed as a cover of the evaporator heat exchanger unit. This cover of the evaporator heat exchanger unit is undetachably connected both to the at least one other housing part and to the collector expansion tank pot, in particular connected by soldering or welding, or it is detachably connected, in particular screwed.

The cover of the evaporator heat exchanger unit can be a cover that together with the at least one other housing part of the housing encloses the inner chamber of the housing and which together with the collector expansion tank pot encloses an inner volume of the collector expansion tank. This inner volume of the collector expansion tank, which is located in the inner chamber of the housing, is delimited from the inner chamber of the housing in a substantially refrigerant proof and cooling medium proof way.

The connection of the cover of the evaporator heat exchanger unit with the collector expansion tank can be configured as a soldered connection or a welded connection. The connections of the cover of the evaporator heat exchanger unit with the at least one other housing part can be formed as screw connections, in particular as screw connections with a plurality of screws.

The cover of the evaporator heat exchanger unit can be configured as a distributor plate, wherein in this distribution plate are located at least one inlet recess, an outlet recess, a connecting channel and an discharge channel The distributor plate can be a cover of the evaporator heat exchanger unit, which is configured such that it can conduct the refrigerant from heat exchanger device to the expansion element, from the expansion element to the evaporator, from the evaporator to the collector expansion tank and from the collector expansion tank to the heat exchanger device, respectively.

In some embodiments, the expansion element is located in the inlet recess of the distributor plate.

In some embodiments, this evaporator is constructed as a bent pipe for conducting the refrigerant. The evaporator can be arranged substantially spirally around a pipe running around the collector expansion tank, in particular it can have a plurality of coils, which are arranged in a single row, double rows or multiple rows. For example, the bent pipe can be constructed such that its complete length exceeds each external dimensions of the evaporator by a several times. By this way, a large surface area of the refrigerant conducting elements of the evaporator is achieved, being in particular advantageous for the heat exchange.

But it is also possible to build the evaporator as multi-part, with bent pipe-like elements, which are each held to each other or to one or more structural parts.

In some embodiments, this evaporator is constructed as a pipe made of a good heat conducting material, especially metal. In a particularly preferred embodiment, the evaporator is formed as an extruded profile with longitudinally oriented ribs, wherein besides ribbings arranged on the outside of the profile ribbings can be also provided inside of the profile. The profile is formed from aluminum and the refrigerant is conducted inside.

In some embodiments, the evaporator is made of a transversely oriented profile with ribbing, wherein the refrigerant is conducted inside this profile which can be formed from aluminum. In another embodiment, this ribbing is substantially formed on the casing, whereby in particular the heat transfer between the evaporator and the cooling medium in the inner chamber of the housing is improved.

BRIEF DESCRIPTION OF THE DRAWINGS

Exemplary embodiments of the evaporator heat exchanger unit according to various embodiments will become apparent from the following description in conjunction with the drawings.

DETAILED DESCRIPTION

Figure 1:
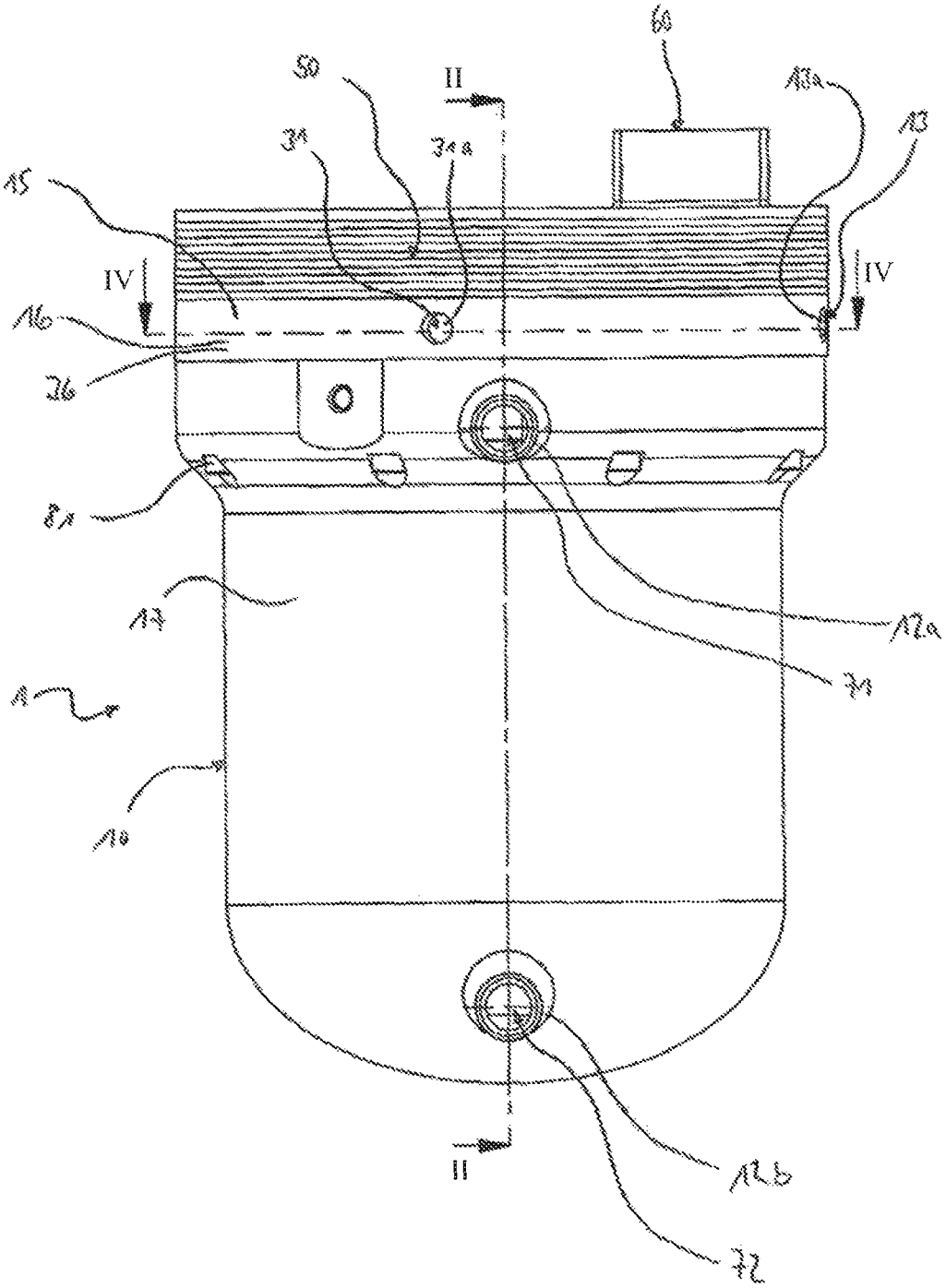
FIG. 1 illustrates an evaporator heat exchanger unit according to embodiments.

FIG. 1 shows an embodiment of an evaporator heat exchanger unit according to embodiments. In this embodiment, the housing 10 of the evaporator heat exchanger unit 1 comprises a first housing part 15 and a second housing part 17. Here, the first housing part 15 is constructed as a distributor plate 16 and simultaneously as a collector expansion tank cap 36. In this embodiment, the first housing part 15 is formed of a metal material.

In the distributor plate 16 is formed an opening for the connecting channel 31 and the expansion element recess 13, respectively, wherein the connecting channel 31 and the expansion element recess 13 are pressure-resistant and fluid-tight sealed in relation to the surroundings of the evaporator heat exchanger unit 1 by the gasket 31*a* and by the gasket 13*a*, respectively.

Regarding the longitudinal axis of the evaporator heat exchanger unit 1, a heat exchanger device 50 is located on the side of the distributor plate 16 which is not connected to the second housing part 17. This heat exchanger device 50 is constructed as a plate heat exchanger, meaning that it has a packet of a several plates which are soldered together and each of which are having a given contour. The contours of these plates are constructed such that they allow a conduction of the refrigerant in two separate channels, a first channel 51 and a second channel 52 (both not shown in FIG. 1).

On the side distant from the housing screws of the heat exchanger device 50, a refrigerant dock 60 is arranged, which has ports for the supply and the discharge of the refrigerant (both not shown in FIG. 1).

The second housing part 17 has an inlet opening 12*a*, which serves as a cooling medium supply 71, and an outlet port 12*b*, which serves as a cooling medium discharge 72. In this embodiment, the second housing part 17 is formed of a plastic material, but it can also be formed from other materials such as a composite plastic material or a metal material.

In this embodiment, the first housing part 15 and the second housing part 17 are detachably connected to each other by eight housing screws 81, but for other embodiments it may be connected in a different manner.

For the description of the following figures, substantially identically formed elements of the evaporator heat exchanger unit are designated by the same reference numerals as the corresponding elements of the evaporator heat exchanger unit of FIG. 1.

Figure 2:
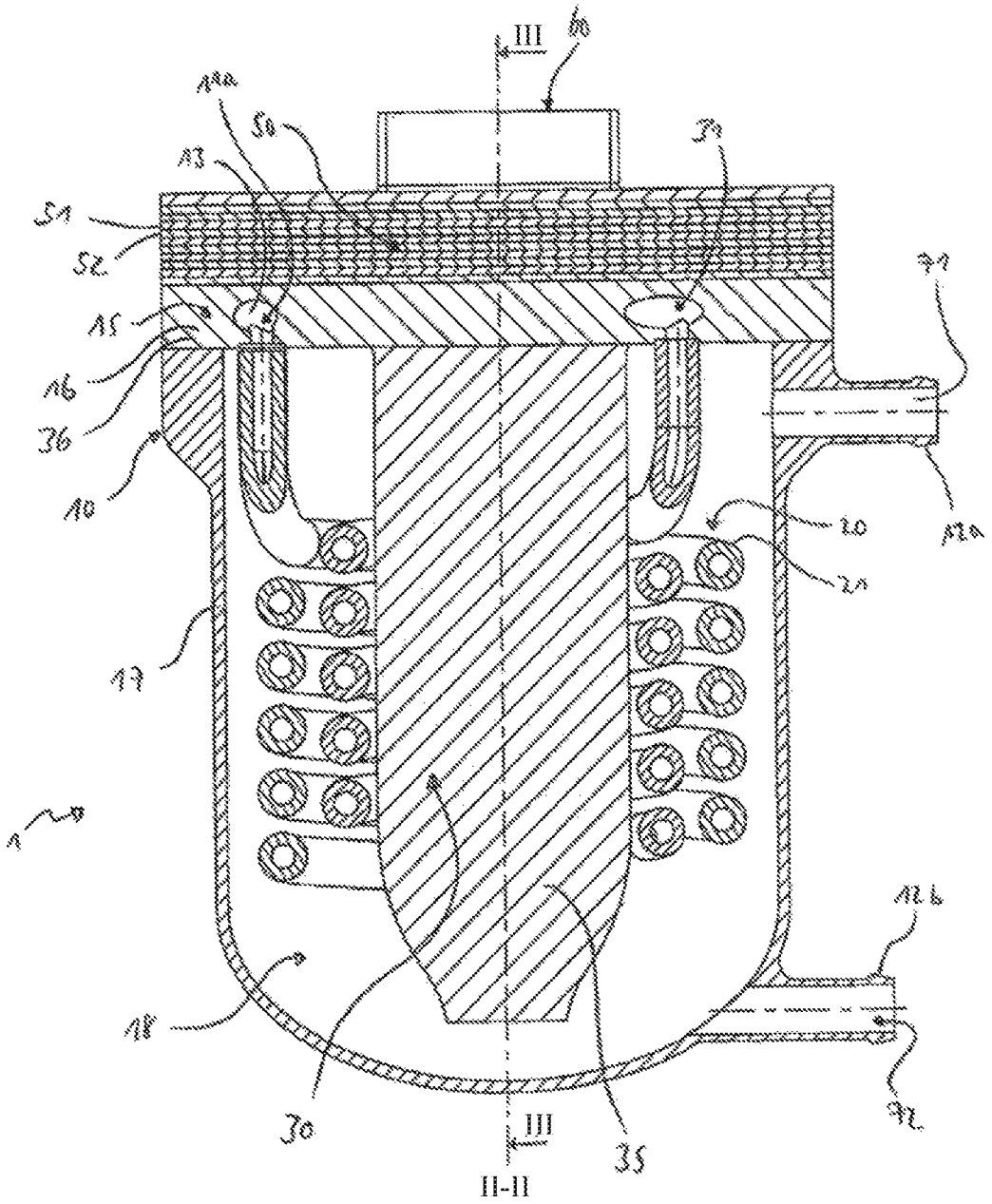
FIG. 2 illustrates a sectional view of the evaporator heat exchanger unit of FIG. 1 according to embodiments.

FIG. 2 shows a sectional view in the plane II-II of the evaporator heat exchanger unit 1 of FIG. 1 according to embodiments. In this embodiment, the refrigerant is supplied to the first channel 51 of the heat exchanger device 50 by a refrigerant supply 61 (not shown in FIG. 2) of the refrigerant dock 60. Thereby, heat is transferred from the refrigerant in the first channel 51 to the refrigerant in the second channel 52 in the heat exchanger device 50 which is formed as a plate heat exchanger in this embodiment.

The refrigerant of the first channel 51 then flows from the first channel 51 into the expansion element recess 13 (not shown in FIG. 2), which is excluded from the first housing part 15 of the housing 10, wherein the first housing part 15 is formed as the distributor plate 16 in this embodiment.

The refrigerant flows from the expansion element recess 13 to the inlet recess 11*a*, and then the refrigerant is supplied to the evaporator 20, where it is conducted in the evaporator coil 21. The evaporator coil 21 is constructed as a spirally bent pipe, which extends in a plurality of turns around the collector expansion tank 30, wherein the refrigerant is conducted away from the distributor plate 16 in an outer winding packet then it is conducted back to the distributor plate 16 in an inner winding packet. However, the evaporator coil 21 also has a non-helical bent part, by which the refrigerant is supplied to the connecting channel 31 of the collector expansion tank 30 after passing through the helical part of the evaporator coil 21. While the refrigerant passes through the evaporator 20, the proportion of the refrigerant in gaseous form rises, whereas the proportion of the refrigerant in liquid form decreases.

The energy required for this is supplied to the refrigerant, for example, by a heat transfer from a cooling medium, which flows around the evaporator coil 21 of the evaporator 20, wherein it flows through the inner chamber 18 of the housing 10, which means that it is between the walls of the second housing part 17, the distributor plate 16 and the collector expansion tank pot 35. The cooling medium supply 71 is performed in this embodiment via the inlet opening 12*a* of the second housing part 17. After the heat transfer from the cooling medium to the refrigerant in the evaporator 20, the cooling medium discharge 72 is done via the outlet opening 12*b* of the second housing part 17, wherein a continuous flow of the cooling medium is provided through the inner chamber 18 of the housing 10.

Figure 3:
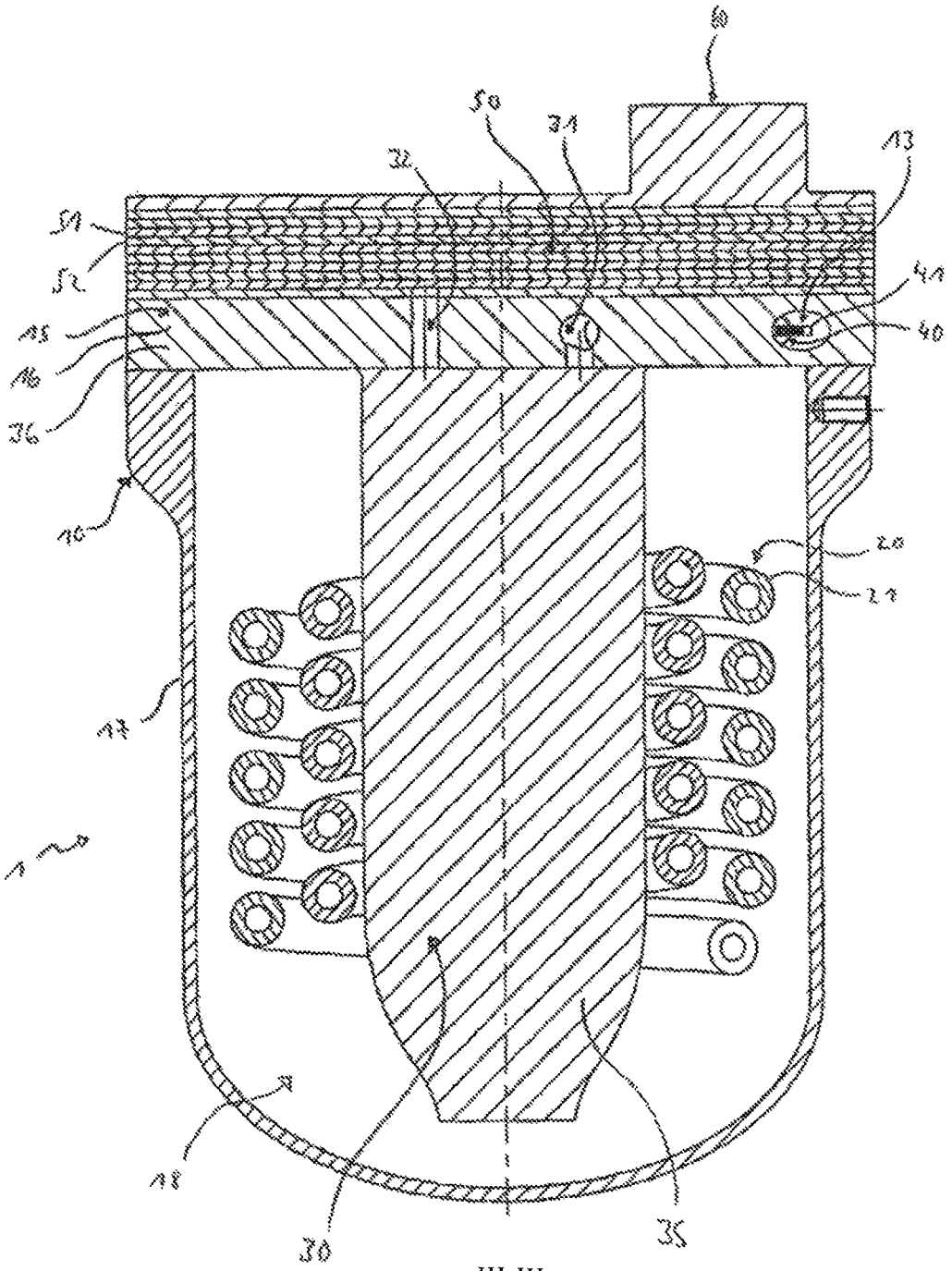
FIG. 3 illustrates a further sectional view of the evaporator heat exchanger unit of FIG. 1 according to embodiments.

FIG. 3 shows a further sectional view of an evaporator heat exchanger unit 1 of FIG. 1 according to embodiments in the plane III-III, whose course can be seen also in FIG. 2. After the refrigerant has passed through the evaporator 20, it is transferred via the communication channel 31 into the collector expansion tank 30, where at least a part of the liquid refrigerant is collected in the collector expansion tank pot 35. An amount of the refrigerant, the amount being dependent on the operating conditions in the refrigerant circuit of the heating cooling module, is supplied from the collector expansion tank 30 through the outlet channel 32 and the outlet recess 11*b* (not shown in FIG. 3) of the housing 10 into the second channel 52 of the heat exchanger device 50 for receiving heat from the refrigerant in the first channel 51 of the heat exchanger device 50.

After passing through this second channel 52 of the heat exchanger device 50, the refrigerant discharge 62 (not shown in FIG. 3) is done from the refrigerant dock 60 of the evaporator heat exchanger unit 1 to other components of the heating cooling module, in this embodiment to the compressor.

The inner chamber 18 of the housing 10 is enclosed in this embodiment by the distributor plate 16 and the second housing part 17, wherein the distributor plate 16 and the second housing part 17 are screwed together using a plurality of housing screws 81. At the distributor plate 16, which has the function of the collector expansion tank cover 36 in this embodiment, the collector expansion tank pot 35 is arranged fluid-tight and pressure-tight by a soldering joint.

Figure 4:
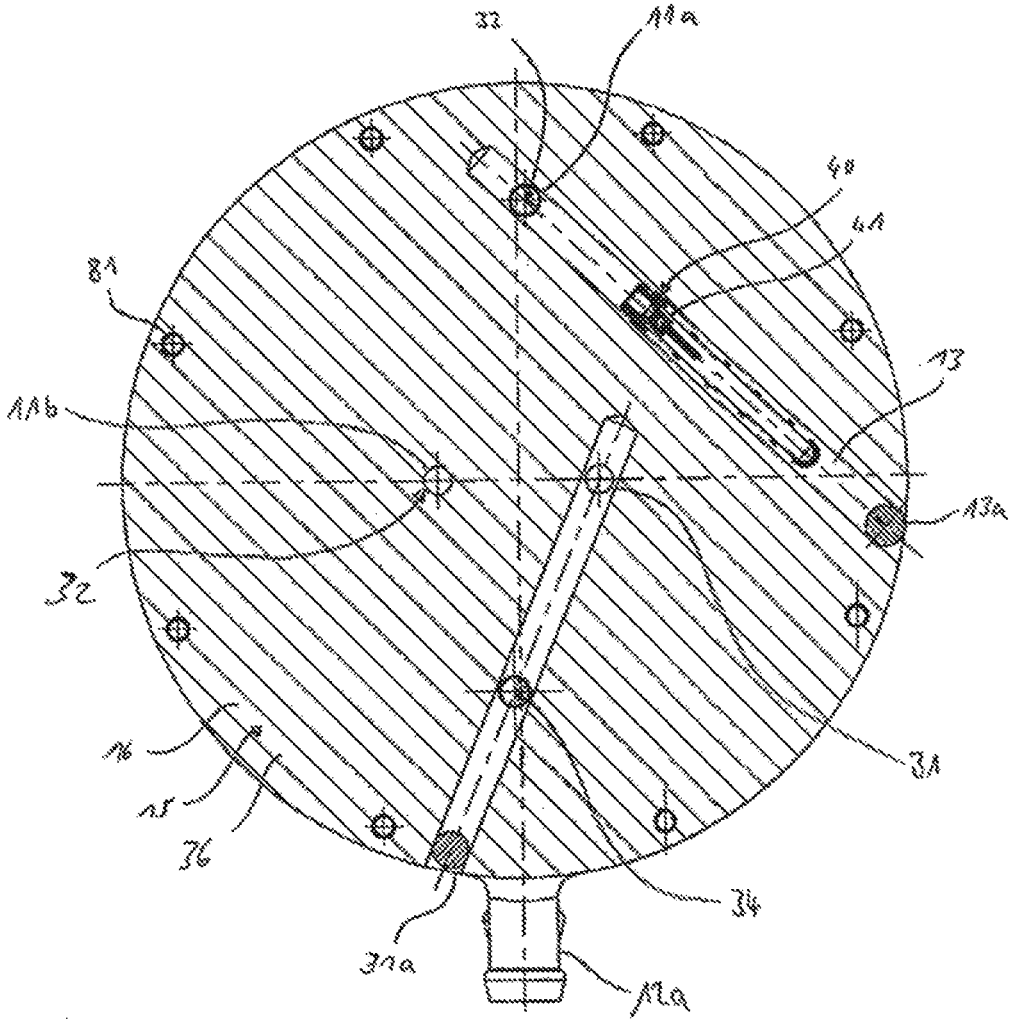
FIG. 4 illustrates a sectional view in the distributor plate of the evaporator heat exchanger unit of FIG. 1 according to embodiments.

FIG. 4 shows a sectional view of the distributor plate 16 of the evaporator heat exchanger unit 1 of FIG. 1 according to embodiments (section plane IV-IV). In the inlet recess 11*a*, the refrigerant is discharged from the expansion element recess 13. Before it, an expansion element 40 is arranged, which is constructed as a fixed throttle 41, for example. The expansion element recess 13 is formed as a part of the inlet recess 11*a*. The refrigerant expands at the fixed throttle 41, whereby the pressure of the refrigerant in the refrigerant flow after passing through the expansion element 40 decreases. The temperature of the refrigerant also decreases.

After passing the fixed throttle 41, the refrigerant in the inlet recess 11*a* is to a large proportion in liquid form and to a small proportion in gaseous form, and it is supplied through the refrigerant port 33 to the evaporator 20 in the evaporator coil 21.

After the refrigerant has passed through the evaporator 20, it is supplied to the collector expansion tank 30 via the refrigerant port 34 by the connection channel 31, which it passes through.

In the distributor plate 16, the outlet recess 11*b* is additionally arranged with the discharge channel 32, wherein the refrigerant is supplied from the collector expansion tank 30 to the second channel 52 of heat exchanger device via the discharge channel 32 and the outlet recess 11*b*.

Figure 5:
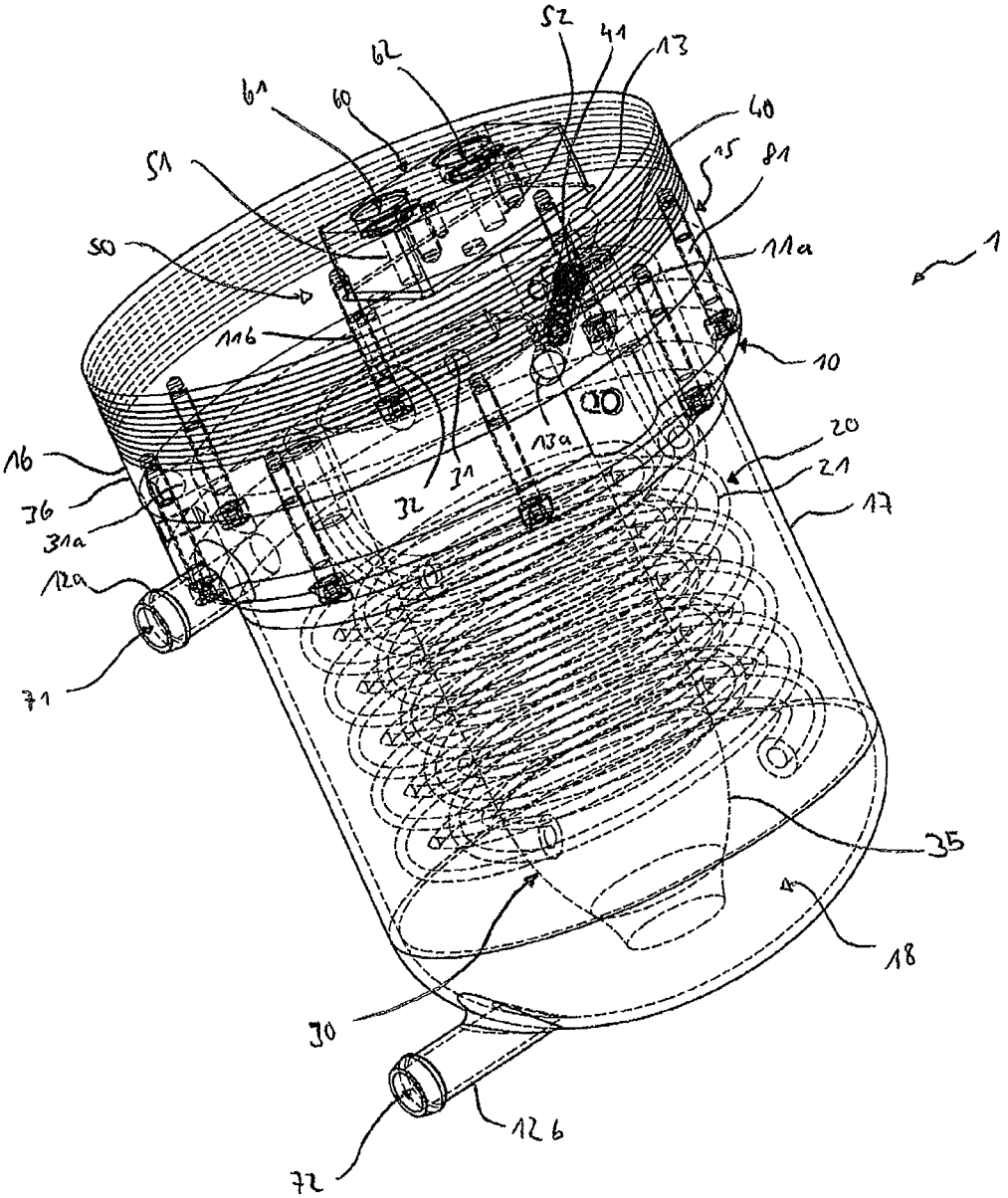
FIG. 5 illustrates a three dimensional view of the evaporator heat exchanger unit of FIG. 1 according to embodiments.
Figure 6:
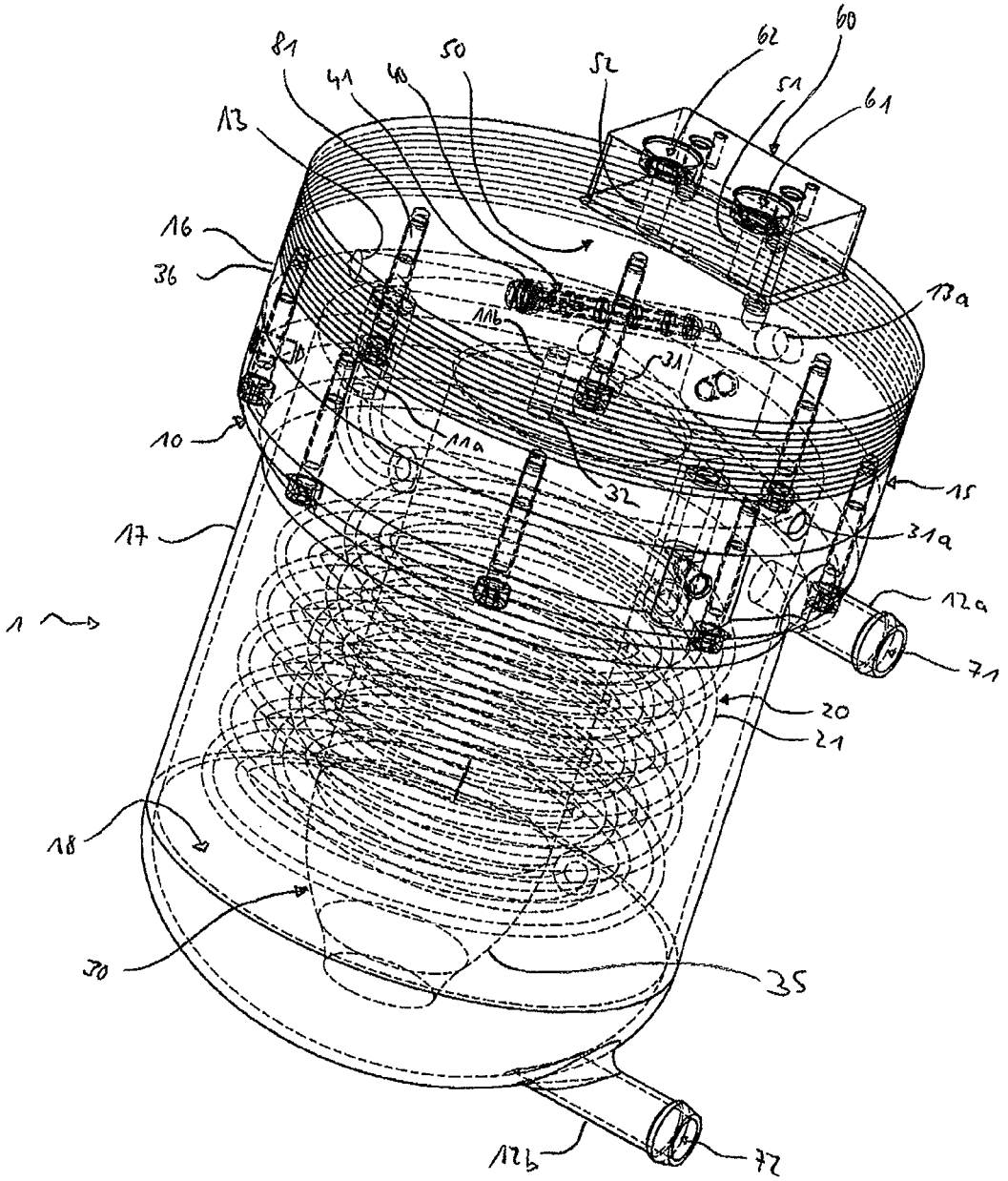
FIG. 6 illustrates another three dimensional view of the evaporator heat exchanger unit of FIG. 1 according to embodiments.

FIGS. 5 and 6 show two different three dimensional sectional views of the evaporator heat exchanger unit 1 of FIG. 1 according to embodiments. Thus, the arrangement of the individual components to each other is further explained. In particular, the arrangement of the refrigerant supply 61 and the refrigerant discharge 62 on the refrigerant dock 60 is shown, which may not be deduced from the previous figures.

In addition, the path of the refrigerant is illustrated, starting with the refrigerant supply 61, through the heat exchanger device 50, through the expansion element 40, through the evaporator 20 and through the collector expansion tank 30 to the refrigerant discharge 62.

The first channel 51 of the heat exchanger device 50 is arranged to begin at the refrigerant supply 61. In its further course is formed by a package of several plates being soldered together and punched in each case in a certain contour, wherein a hollow space, which is separated from the second channel 52 and which conducts the refrigerant and in which the refrigerant is supplied to expansion element recess 13, is formed by these embossed contours. In the second channel 52 being formed analogously the refrigerant is transferred to the refrigerant discharge after passing through the evaporator 20 from the collector expansion tank 30. By this configuration, a good heat transfer to the refrigerant in the second channel 52 occurs between the refrigerant flows in the first channel 51 and second channel 52.

While the above description has pointed out features of various embodiments, the skilled person will understand that various omissions, substitutions, and changes in the form and details of the device or process illustrated may be made without departing from the scope of the appended claims.

What is claimed is:

1. An evaporator heat exchanger unit for a heating-cooling module for a motor vehicle, the evaporator heat exchanger unit comprising:

a housing having a first housing part defining an inner chamber for containing a cooling medium;

a collector expansion tank disposed within the inner chamber and configured to collect a refrigerant;

an evaporator disposed within the inner chamber and configured to transform at least a part of the refrigerant into a gaseous state and to cool the cooling medium;

the housing having a second housing part enclosing the collector expansion tank and the evaporator within the inner chamber;

a plate heat exchanger attached to an outer face of the second housing part and comprised of a plurality of plates interconnected to one another and each having a contour to collectively define at least one first channel and at least one second channel; and the at least one first channel in fluid communication with the evaporator and the at least one second channel in fluid communication with the collector expansion tank for guiding the refrigerant to enter and exit the collector expansion tank and the evaporator for transferring heat from the refrigerant entering the evaporator and the collector expansion tank to refrigerant exiting the evaporator and the collector expansion tank.

2. The evaporator heat exchanger unit according to claim 1, wherein the evaporator is arranged substantially around the collector expansion tank.

3. The evaporator heat exchanger unit according to claim 1, wherein the housing comprises at least one inlet recess through which the refrigerant to be supplied to the evaporator passes, and at least one outlet recess through which the refrigerant discharged from the collector expansion tank passes.

4. The evaporator heat exchanger unit according to claim 1, wherein the housing comprises i) at least one inlet opening through which the cooling medium to be supplied to the inner chamber enclosed by the housing passes and ii) at least one outlet opening through which the cooling medium passes in order to be discharged from the inner chamber enclosed by the housing.

5. The evaporator heat exchanger unit according to claim 1, wherein the collector expansion tank comprises i) at least one connecting channel through which the refrigerant to be supplied to the collector expansion tank passes and ii) at least one outlet channel through which the refrigerant discharged from the collector expansion tank passes.

6. The evaporator heat exchanger unit according to claim 1, wherein the collector expansion tank comprises a collector expansion tank pot and a collector expansion tank cover.

7. The evaporator heat exchanger unit according to claim 6, wherein the second housing part and the collector expansion tank cover are substantially formed integrally as a cover of the evaporator heat exchanger unit, and wherein the cover of the evaporator heat exchanger unit is connected to the first housing part and to the collector expansion tank pot, respectively.

8. The evaporator heat exchanger unit according to claim 7, wherein the cover of the evaporator heat exchanger unit is constructed as a distributor plate, and wherein at least one inlet recess and an outlet recess, a connecting channel and a discharge channel are arranged in the distributor plate.

9. The evaporator heat exchanger unit according to claim 8, wherein a part of the inlet recess of the distributor plate is formed as an expansion element recess, and wherein an expansion element is arranged in the expansion element recess.

10. The evaporator heat exchanger unit according to claim 1, wherein the evaporator is formed substantially as a bent pipe configured to conduct the refrigerant.

11. The evaporator heat exchanger unit according to claim 1, wherein the evaporator is formed as an extruded metal profile, or as an aluminum profile, and wherein the refrigerant is configured to be conducted within this metal profile.

12. The evaporator heat exchanger unit according to claim 1, wherein the plurality of plates are soldered to one another.

13. An evaporator heat exchanger unit for a heating-cooling module for a motor vehicle, the evaporator heat exchanger unit comprising:

a housing having a first part being cup-shaped and defining an inner chamber for containing a cooling medium;

a collector expansion tank disposed within the inner chamber and configured to collect a refrigerant;

an evaporator coil spirally disposed about and in fluid communication with the collector expansion tank and configured to transform at least a part of the refrigerant into a gaseous state and to cool the cooling medium;

the housing having a second part attached to the first part to enclose the collector expansion tank and the evaporator coil within the inner chamber;

an expansion element arranged in the second part of the housing and coupled to the evaporator and configured to supply the refrigerant to the evaporator coil;

a plate heat exchanger device attached to an outer face of the second part of the housing and comprised of a plurality of plates interconnected to one another each having a contour to collective define a first channel in fluid communication with the evaporator and a second channel in fluid communication with the expansion element for transferring heat from the refrigerant entering the expansion element to refrigerant exiting the evaporator.

14. The evaporator heat exchanger unit according to claim 13, wherein the expansion element is arranged in a refrigerant flow between the plate heat exchanger device and the evaporator, and wherein the expansion element is formed in an expansion element recess of one of the housing parts.

15. The evaporator heat exchanger unit according to claim 13, wherein the expansion element is arranged in a refrigerant flow between the plate heat exchanger device and the evaporator, and wherein the expansion element is connected to one of the housing parts.

16. The evaporator heat exchanger unit according to claim 13, wherein the evaporator coil is helical in shape and includes an inner winding packet disposed immediately adjacent the collector expansion tank for conducting the refrigerant out of the evaporator coil and an outer winding packet disposed about and radially outwardly from the inner winding packet for conducting the refrigerant entering the evaporator coil.

17. The evaporator heat exchanger unit according to claim 13, further including a refrigerant dock attached to and fluidly coupled with the plate heat exchanger device for conveying the refrigerant into and out of the plate heat exchanger device.

* * * * *